US005634840A

United States Patent [19]

Watkins

[11] Patent Number: 5,634,840

[45] Date of Patent: *Jun. 3, 1997

[54] CONTROLLABLE CONFETTI PROJECTOR

[76] Inventor: James O. Watkins, 14920 Mt. Nebo Rd., Poolesville, Md. 20837

[ * ] Notice: The term of this patent shall not extend beyond the expiration date of Pat. No. 5,403,225.

[21] Appl. No.: 490,406

[22] Filed: Jun. 14, 1995

[51] Int. Cl.[6] ..... A63H 33/30; A63H 37/00

[52] U.S. Cl. ..... 446/475

[58] Field of Search ..... 446/475, 176, 446/211, 213, 216; 124/73, 74

[56] References Cited

U.S. PATENT DOCUMENTS 3,445,069 5/1969 Druge ..... 124/73 X
3,780,720 12/1973 Alderson ..... 124/74
5,149,290 9/1992 Reveen ..... 446/475
5,403,225 4/1995 Watkins ..... 446/475

FOREIGN PATENT DOCUMENTS 1710086 2/1992 U.S.S.R. ..... 446/475

*Primary Examiner*—Mickey Yu
*Attorney, Agent, or Firm*—Ronald B. Sherer

[57] ABSTRACT

A system for launching confetti into the air is disclosed in which a gas cylinder is connected to a barrel containing confetti through a manually operated on-off valve. In a preferred embodiment of the invention, the valve is a pressure reduction valve, and the confetti comprises stacks of elongated tetragonal-shaped confetti.

8 Claims, 1 Drawing Sheet

CONTROLLABLE CONFETTI PROJECTOR

FIELD OF THE INVENTION

This invention relates to a compressed gas system for launching confetti, and more particularly to a small, lightweight and safe confetti launcher which may be used by both professionals and non-professionals.

BACKGROUND

The use of so-called "cannons" by professionals to shoot confetti at amusement parks, concerts, and other events has long been enthusiastically enjoyed by audiences. Such cannons are powered by compressed gas tanks, or compressed gas cylinders, which operate at pressures in the order of 600–800 p.s.i., and the cannons are usually in the order of several feet long, with a wall thickness in the order of ¼ inch and composed of PVC or metal tubing. Accordingly, such systems are expensive, bulky and are not safe in the hands of non-professionals. In addition, cannons which are designed for use with $CO_2$ cartridges, such as those disclosed in U.S. Pat. Nos. 2,756,737 and 5,149,290 operate on the basis of puncturing the seal on the $CO_2$ cartridge such that the entire cartridge is suddenly emptied of the high pressure gas in one, uncontrolled and uncontrollable discharge. Such operation not only has obvious safety hazards, but it is also expensive in that each $CO_2$ cartridge can only provide one shot of confetti from the cannon. Thus, it is not possible to shoot a plurality of small loads of confetti with a single cartridge as is desirable for the professional on stage or the non-professional at relatively small parties and other festive occasions.

SUMMARY

The present invention overcomes all of the above-indicated problems and hazards of prior art confetti cannons by providing a small, lightweight, hand-held confetti launching system which includes a readily operated on-off valve for controlling the flow of relatively low pressure gas into a confetti-filled barrel from a relatively high pressure cylinder, such as a $CO_2$ cartridge. These and other objects and advantages will become apparent from the following description of one preferred embodiment of the invention as illustrated in the following drawings.

DETAILED DESCRIPTION

Figure 1:
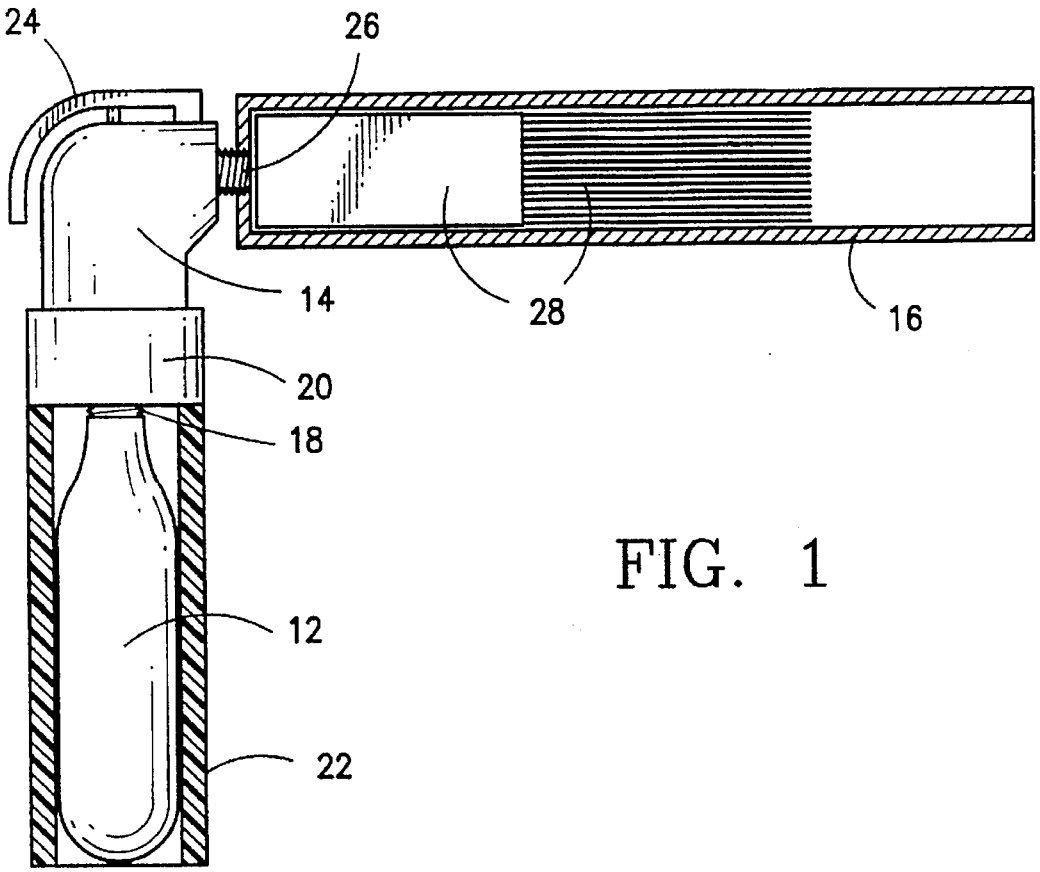
FIG. 1 is a simplified elevational view of the confetti launching system of the present invention.

Referring to FIG. 1, numeral 10 indicates the present confetti system which comprises compressed gas cylinder 12, valve-trigger assembly 14 and confetti-filled barrel 16. Cylinder 12 may be a commercially available $CO_2$ cartridge. Such cartridges are available in 16 gram and 38 gram sizes, both of which are of a size such as to be conveniently held in the hand. The cartridges include a threaded neck portion 18 which is simply threaded into base 20 of the valve-trigger assembly 14. While the cylinder may be grasped directly by hand, it is preferred that a thermally insulating sleeve 22 be provided around the cylinder since the cylinder may become cool as the compressed and/or liquefied gas is discharged.

Figure 2:
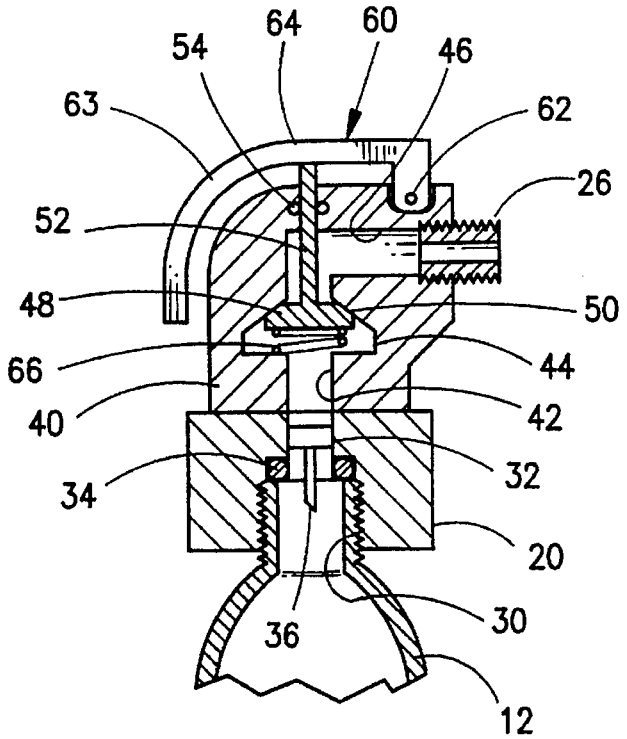
FIG. 2 is an enlarged, simplified view, partly in cross-section, showing the details of one possible valve-and-trigger assembly for use in the present invention.

While the details of the valve-trigger assembly 14 will be described hereinafter with reference to FIG. 2, it will be understood that assembly 14 contains a manually operable, on-off, pressure-reduction valve which is normally closed, and which may be opened and closed by actuating trigger 24. The downstream, low pressure side of the valve is connected through an internal passage to a threaded fitting 26 which connects the internal passage to the internal end of confetti barrel 16. Preferably, fitting 26 is permanently secured to the valve body by a retaining pin (not shown) or glued, or otherwise secured such that the fitting remains connected to the valve body while the confetti barrel 16 may be removed from the fitting.

Confetti barrel 16 may be supplied to the user prefilled with confetti 28, and the barrel may be composed of thin-walled plastic, flexible vinyl or cardboard so as to be discarded after each use and replaced by another prefilled barrel. Alternatively, the barrel may be composed of more durable material such as PVC tubing and may be loaded by the user by simply inserting one or more stacks 28 of elongated, tetragonal-shaped confetti; such confetti being known under the trademark FLUTTER FETTI® and being described more fully in U.S. Pat. Nos. 5,352,148 and 5,403,225, which patents are hereby incorporated by reference. In either case, where more than one stack or wrapped bundle of confetti 28 is contained along the length of the barrel, it is preferred that the layers of confetti in the stacks or bundles be oriented at an angle with respect to each other as more fully described in U.S. Pat. No. 5,403,225.

While barrel 16 may be of a wide range of sizes, for non-professional use it has been discovered that a preferred range of internal diameters is between 0.5 and 1.0 inches. The length of the barrel should be between 3 and 12 inches, and preferably between 4 and 7 inches. Within these ranges, the barrel may be loaded with between one and four stacks or bundles of FLUTTER FETTI confetti, and a single $CO_2$ cartridge will be sufficient to launch two to three loads of confetti.

The details of the valve-trigger assembly 14 will now be described with reference to FIG. 2 which is a simplified, schematic illustration of one example of a valve suitable for use in the present invention. Assembly 14 includes a base portion 20 which may be composed of metal and is provided with a threaded bore 30 which receives the threaded neck portion 18 of the $CO_2$ cartridge. Bore 30 extends into a reduced-diameter counter-bore 32 and a seal, such as one or more O-rings 34, is provided to seal against the end of the cartridge. Counter-bore 32 supports a hollow puncturing needle 36 which may be threaded into the bore or be supported by a web in the counter-bore. Of course, other arrangements of these elements are possible; however, it is important that the seal 34 and the tip of needle 36 are positioned such that, as the cartridge is screwed into base 20, the seal engages the end of the cartridge before the tip of the needle punctures the high pressure seal on the cartridge so that high pressure gas is not lost in making the connection.

Valve-trigger assembly 14 further includes a valve body portion 40 which may be made of plastic. Valve body 40 includes a high pressure fluid passage 42 in communication with counter-bore 32, and high pressure passage 42 opens into a valve chamber 44. Valve chamber 44 is connected to a downstream, low pressure passage 46, which leads to fitting 26 previously described, and a valve head 48 is interposed between valve chamber 44 and low pressure passage 46; valve head 48 being seated against a valve seat 50 formed in the valve body. Valve head 48 is illustrated as being connected to, or integral with, a valve stem 52 which extends through the valve body. Valve stem 52 may be provided with one or more fluid seals 54 which may be in the form of O-rings as shown, or other types of known seals, and it will be understood that the valve head and stem may be separate elements, and that valve head may be a ball or other shape of valve head.

Valve-trigger assembly 14 further includes a trigger 60 which is pivoted to the valve body by a pin 62. Trigger 60 includes an arm portion 64 which engages the end of valve stem 52. Therefore, valve head 48 may be moved downwardly, as viewed in FIG. 2, away from valve seat 50 when the curved portion 63 of trigger arm 64 is momentarily pressed downwardly by the thumb of the user. This momentary opening of the valve permits high pressure gas from passage 42 to flow into valve chamber 44 where the pressure is greatly reduced in flowing through the highly restricted area between valve head 48 and valve seat 50. Thus, relatively low pressure gas flows through low pressure passage 46 and fitting 26 into confetti barrel 16 which makes the present confetti system quite safe. However, this momentary burst of gas is entirely sufficient to eject the very lightweight confetti many feet into the air. It will also be noted that the valve is strongly biased toward the closed position by virtue of the high pressure gas acting against the relatively large surface area of valve head 48. However, if desired, additional biasing means, such as a compression spring 66 may be included in order to further assure that the valve remains closed at all times other than when trigger 60 is manually actuated. These and other variations in the details of the valve design will be apparent to those skilled in the valve art and include, for example, the valves sold by Leland Limited, Inc. of Bedminster, N.J. for use in dust and particle remover systems using $CO_2$ cartridges which are sold under the trademark POWER CLEAN. Therefore, it is to be understood that the foregoing description of one preferred embodiment of the invention is intended to be purely illustrative of the principles of the invention, rather than limiting thereof, and that the legal scope of the invention is not intended to be limited other than as expressly set forth in the following claims interpreted under the doctrine of equivalents.

What is claimed is:

1. A confetti launching system comprising:

(a) a cylinder of compressed gas at high pressure;

(b) a manually operated on-off valve, said on-off valve having an inlet connected to said cylinder, a valve seat and a movable valve head;

(c) means for puncturing said cylinder and admitting high pressure gas to said valve inlet;

(d) an outlet passage connected to said on-off valve;

(e) a hollow barrel containing at least one stack of elongated tetragonal shaped confetti connected to said outlet passage; and (f) a manually actuated trigger connected to said valve head to open and close said on-off valve and selectively admit gas into said hollow barrel and eject confetti from said barrel high into the air.

2. The confetti launching system of claim 1 wherein said length is in the order of 4 to 7 inches.

3. The confetti launching system of claim 1 wherein said valve head is located in a valve chamber, and wherein said high pressure gas biases said valve head into closed position against said valve seat.

4. The confetti launching system of claim 1 wherein said valve includes a valve body and said trigger is pivoted to said valve body, and wherein said trigger is positioned such as to be actuated by the thumb of the user when said cylinder is held in the hand of the user.

5. The confetti launching system of claim 1 wherein said hollow barrel contains in the order of 1 to 4 stacks of elongated tetragonal-shaped confetti.

6. The confetti launching system of claim 3 wherein the flow area between said valve head and said valve seat is such as to produce a substantial pressure drop in said high pressure gas in flowing therethrough when said valve is opened by actuation of said trigger.

7. A hand-held confetti launching system comprising:

(a) a cylinder of compressed gas at high pressure;

(b) a manually operated on-off valve, said valve including an inlet, an outlet and a valve chamber;

(c) a valve seat and a movable valve head engaging said valve eat, said valve seat and said valve head positioned in said valve chamber such as to reduce the pressure of said high pressure gas in flowing therethrough;

(d) said gas cylinder being connected to said valve inlet;

(e) means for puncturing said cylinder and thereby admitting high pressure gas into said inlet and into said valve chamber;

(f) a hollow barrel connected to said valve outlet, said hollow barrel containing at least one stack of elongated tetragonal-shaped confetti; and (g) trigger means connected to said valve head for opening and closing said on-off valve to selectively admit gas at reduced pressure into said barrel and eject said stack of tetragonal-shaped confetti from said barrel.

8. The confetti launching system of claim 7 wherein said trigger means comprises a pivoted lever, said pivoted lever being pivotally connected to said on-off valve, said pivoted lever being positioned such that said lever is positioned adjacent the thumb of the user when said cylinder is held in the user's hand.

* * * * *